United States Patent [19]

Nelson

[11] 4,254,572

[45] Mar. 10, 1981

[54] LUBRICATOR-LOADER FOR FIREARMS

[76] Inventor: Henry R. Nelson, R.D. #2, Box 66, Lambertville, N.J. 08530

[21] Appl. No.: 40,602

[22] Filed: May 18, 1979

[51] Int. Cl.[3] ..... F41C 27/00

[52] U.S. Cl. ..... 42/90

[58] Field of Search ..... 42/90; 86/19

[56] References Cited

U.S. PATENT DOCUMENTS

| | | | |
|---|---|---|---|
| 47,784 | 5/1865 | Ball | 86/19 |
| 97,806 | 12/1869 | Pickersgill | 86/19 |
| 476,175 | 5/1892 | Stewart | 86/19 |
| 3,747,252 | 7/1973 | Walker | 42/90 |
| 4,094,098 | 6/1978 | Gourley | 42/90 |
| 4,108,044 | 8/1978 | Brown | 86/19 |
| 4,112,606 | 9/1978 | Griffin | 42/90 |
| 4,123,868 | 11/1978 | Wilson | 42/90 |
| 4,152,858 | 5/1979 | Dobbs | 42/90 |

*Primary Examiner*—Charles T. Jordan

*Attorney, Agent, or Firm*—Blum, Kaplan, Friedman, Silberman and Beran

[57] ABSTRACT

A simple lubricator-loader provides for lubrication of a bullet for a muzzle-loading firearm and then for insertion of the bullet into the firearm. The lubricator-loader is so constructed that both operations can be effected without bringing the fingers into contact with the bullet subsequent to lubrication thereof.

6 Claims, 2 Drawing Figures

2
2
11
12
13
14
16
17
18
19
21
22
23
24
26
27
28
29
31
32
33

LUBRICATOR-LOADER FOR FIREARMS

BACKGROUND OF THE INVENTION

A bullet to be used in a muzzle-loading firearm is generally first lubricated. Then, subsequent to the lubrication operation, the bullet is inserted into the muzzle of the gun using a ramrod. Lubrication of the sidewall of the bullet is a somewhat messy operation, and a variety of devices have been disclosed for carrying out this procedure, examples being those taught in U.S. Pat. Nos. 476,175; 2,403,032; and 4,108,044. These are generally relatively complex devices, which cannot readily be slipped into the pocket of a coat and which in some cases require fastening to a bench, so that such constructions cannot readily be used in the field.

Loading devices have also been disclosed in the prior art, examples being those in U.S. Pat. Nos. 3,747,252 and 4,094,098. The loading tools are somewhat simpler in construction, but they require that the lubricated bullet be handled with the fingers. This not only results in soiling of the fingers or a glove, if used, but also results in loss of lubricant from the side of the bullet and possible transfer of lubricant to other areas.

Accordingly, a device which would provide for both lubrication and the loading operation without handling of the bullet subsequent to lubrication and which is yet simple enough in construction and light enough in weight so that it can be readily carried about and used in the field is greatly to be desired.

SUMMARY OF THE INVENTION

The simple lubricator-loader of the present invention is generally T-shaped, comprising a main arm and a side arm. The side arm divides the main arm into a first portion and a second portion, the first portion having an internal diameter large enough to accept the bullet to be lubricated. The second portion has an internal diameter sized for receiving a ramrod slidably, the diameter of the ramrod being less than that of the bullet. The interior end of the second portion stops short of the side arm, presenting a shoulder at a location such that when the bullet comes to rest against it, the sidewall of the bullet is in registry with the bore of the side arm. Lubricant can be inserted through the side arm when it is held perpendicularly so that it will drop onto the sidewall of the bullet.

In a preferred construction, the second portion of the side arm consists of an outer wall and a hollow inner cylinder, the outer wall being integral with the side arm and the first portion. The inner cylinder is preferably of a material such as rubber which fits tightly within the outer wall. A liner may be present in the side arm, the inner diameter of the liner being such that it will conveniently receive the delivery end of a lubricant container.

Accordingly, an object of the present invention is a lubricator-loader of simple construction which provides for lubrication of a bullet and insertion into the muzzle of a firearm without handling of the bullet subsequent to lubrication thereof.

Another object of the present invention is a lubricator-loader of simple construction which is sufficiently light in weight and small enough so that it can readily be transported and used in the field.

A further object of the present invention is a lubricator-loader for a firearm where the outer wall of the device is of a molded plastic.

Still other objects and advantages of the invention will in part be obvious and will in part be apparent from the specification.

The invention accordingly comprises an article of manufacture possessing the features, properties, and relationship of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2:
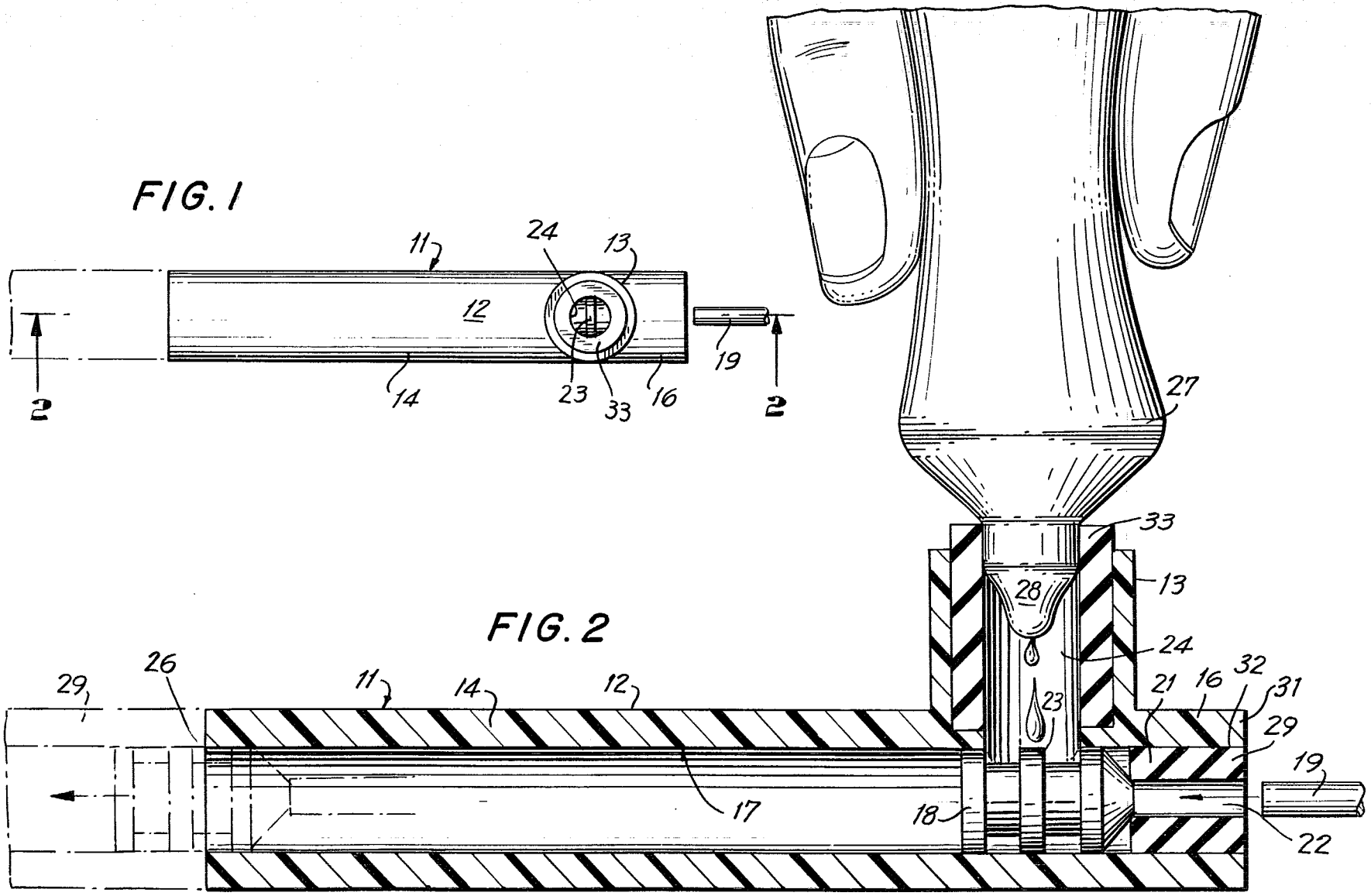
FIG. 1 is a plan view of an embodiment of the invention.
FIG. 2 is an elevational sectional view of the embodiment of FIG. 1.

The lubricator-loader of the present invention is essentially T-shaped in configuration, the lubricator-loader being indicated generally by the reference numeral 11 in FIGS. 1 and 2. The device has two arms, a main arm 12 and a side arm 13. Main arm 12 is divided into a first portion 14 and a second portion 16.

The bore, or inner diameter, 17 of first portion 14 is such that it receives bullet 18 slidably. The bore, or inner diameter, of second portion 16 is such that it receives a ramrod 19 slidably. The diameter of the ramrod 19 is less than that of bullet 18, so that the inner diameter of second portion 16 is reduced below that of inner diameter 17 of first portion 14. Consequently, a shoulder 21 is presented at the inner end of ramrod passage 22. Shoulder 21 is so disposed that sidewall 23 of bullet 18 is in registry with passage 24 of side arm 13 when the bullet is dropped into open end 26 of main arm 12 or pushed into position as by the use of the ramrod.

To carry out the lubrication step, the device is oriented as shown in FIG. 2, with side arm 13 vertical; a container 27 may be brought into position so that the delivery end 28 thereof is within passage 24 and the desired quantity of lubricant is transferred from the container to the sidewall 23 of bullet 18.

To carry out the loading step, container 27 is removed, ramrod 19 is inserted into passage 22, and bullet 18 is transferred into the muzzle 29 of a firearm (shown in phantom). To facilitate positioning the lubricator-loader coaxially with the firearm, either the first or the second portion of main arm 12 is long enough to be readily grasped by the hand. As will be evident, both the operations of lubricating the bullet and transferring same to the firearm are carried out by the use of the same device and without bringing the fingers or hand into contact with the bullet, so that transfer of the lubricant to undesired areas is avoided completely. Moreover, the two operations can be carried out by the device, which is simple in construction, light in weight and of small size.

In a preferred embodiment, the reduced diameter of second portion 16 is obtained through the use of a hollow cylinder 29 seated within the outer cylindrical portion 31. The bore 32 of outer cylindrical portion 31 can then be the same as bore 17 of first portion 14, and the outer diameter of inner cylinder 29 is such as to provide a friction fit with outer cylindrical portion 31. A suitable material for inner cylinder 29 is rubber, but, as is obvious, any light material, such as plastic or magnesium, would be equally suitable. Preferably, first portion 14, outer cylindrical portion 31 and side arm 13 are all integral and of molded plastic.

Side arm 13 may be provided with a liner 33, which can be sized to receive the delivery end of container 27. Preferably, the liner is of a soft material, such as rubber, and is sized to provide a sliding fit with the delivery end of the container.

It will thus be seen that the objects set forth above, among those made apparent from the preceding description, are efficiently attained, and since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. Simple lubricator-loader for lubrication and insertion of bullets into the muzzle of a firearm, comprising a main arm and a side arm, said side arm dividing said main arm into a first portion and a second portion, said first portion of said main arm having a cylindrical bore for receiving slidably a bullet of selected diameter, said side arm having a bore for introduction of lubricant and transfer of said lubricant therethrough to the sidewall of said bullet, said second portion having a cylindrical bore of diameter reduced below that of said first portion for receiving slidably a ramrod of diameter smaller than that of said bullet, said second portion including a shoulder for positioning a bullet inserted into said first portion in registry with the bore of said side arm, at least one of said first portion and second portion being long enough to be readily grasped for holding the free end of said main arm of said lubricator-loader against the muzzle of a firearm during a loading operation.

2. The lubricator-loader as defined in claim 1, wherein said second portion includes an outer hollow cylinder integral with said first portion and said side arm, and an inner hollow cylinder fitting tightly within said outer hollow cylinder, an end of said inner cylinder forming said shoulder.

3. The lubricator-loader as defined in claim 2, wherein said first portion, said side arm and said outer hollow cylinder are of a molded plastic.

4. The lubricator-loader as defined in claim 2, wherein said inner hollow cylinder is of rubber.

5. The lubricator-loader as defined in claim 1, further comprising a liner within said side arm, the inner diameter of said liner being such as to receive slidably the delivery end of a lubricant container.

6. The lubricator-loader as defined in claim 1, wherein said portion long enough to be grasped is said first portion.

* * * * *